US005273462A

United States Patent [19]

Huser et al.

[11] Patent Number: 5,273,462

[45] Date of Patent: Dec. 28, 1993

[54] CONNECTOR KEYING SYSTEM

[75] Inventors: Max Huser, Mönthal; Stefan Schneeberger, Steffisburg, both of Switzerland; Wilhelmus Simons, Heppenheim; Gunter Feldmeier, Lorsch, both of Fed. Rep. of Germany

[73] Assignee: Asea Brown Boveri Ltd., Switzerland

[21] Appl. No.: 768,277

[22] PCT Filed: Dec. 19, 1990

[86] PCT No.: PCT/EP90/02237

§ 371 Date: Oct. 2, 1991

§ 102(e) Date: Oct. 2, 1991

[87] PCT Pub. No.: WO91/10271

PCT Pub. Date: Jul. 11, 1991

[30] Foreign Application Priority Data

Dec. 21, 1989 [GB] United Kingdom ..... 8928879

[51] Int. Cl.[5] ..... H01R 13/64

[52] U.S. Cl. ..... 439/681; 439/341

[58] Field of Search ..... 439/679, 680, 681, 691, 439/341, 677, 633, 367

[56] References Cited

U.S. PATENT DOCUMENTS

| | | | |
|---|---|---|---|
| 3,617,985 | 11/1971 | Kehl | 439/341 |
| 3,714,617 | 1/1973 | Bright et al. | 439/681 |
| 3,969,796 | 7/1976 | Hodsdon et al. | 439/341 |
| 4,082,400 | 4/1978 | Gansent | 439/341 |
| 4,159,862 | 7/1979 | Funck et al. | 439/681 |
| 4,929,184 | 5/1990 | Emadi et al. | 439/681 |
| 4,934,950 | 6/1990 | Green et al. | 439/681 |
| 5,000,701 | 3/1991 | Norden | 439/681 |

FOREIGN PATENT DOCUMENTS

| | | | |
|---|---|---|---|
| 2532885 | 12/1976 | Fed. Rep. of Germany | 439/680 |

*Primary Examiner*—Larry I. Schwartz
*Assistant Examiner*—Hien D. Vu
*Attorney, Agent, or Firm*—Ostrolenk, Faber, Gerb & Soffen

[57] ABSTRACT

The connector keying system has a first connector housing (4) with a mating surface and a second connector housing (2) with a mating surface. The second housing (2) is movable relative to the first housing (4). In this system a programming of the keying shall occur automatically as the connector housings (2, 4) are mated together. This achieved as follows: A keying means receiving recess (23) is provided on the mating surface of the first connector housing (4) proximate an end thereof. A keying means is provided in the recess (23). The keying means has a first (22) and a second keying member (24). The first keying member (22) is secured to the first connector housing (4) by first securing means (50, 52). The second keying member (24) is frictionally maintained in corporation with the first keying member (22). The second keying member (24) has second securing means which are provided to cooperate with the second connector housing when the connector housings (2, 4) are mated together.

18 Claims, 4 Drawing Sheets

CONNECTOR KEYING SYSTEM

FIELD OF THE INVENTION

The present invention is directed to the field of electrical connectors and more particularly to the keying of matable connector housings.

BACKGROUND OF THE INVENTION

Various conventional keying arrangements utilize keying projections on one of a pair of matable connector housings which are received into corresponding keying grooves or channels of the other of the housings. Such keying arrangements permit mating of the appropriate corresponding connectors while preventing the mating of similar appearing connectors which are not intended to be mated. Certain prior art connectors include keying projections which are fabricated integrally with the housing at preselected locations, which necessitates manufacture of a plurality of housings different only in their particular keying projection arrangements. Other prior art connectors are first fabricated without keying projections, and separate key members are secured at desired locations in a further procedure, requiring the handling of many pieces and the time and labor of an operator to insure that the proper keying arrangement is incorporated.

Several connectors have incorporated programmable keying members therein. As shown in U.S. Pat. No. 4,832,625, plug and receptacle connector housings are molded with a plurality of deflectable members proximate their mating faces along housing side walls which become adjacent each other upon connector mating. The deflectable members are joined to respective housing side walls so that the deflectable members are deflectable thereinto if desired, enabling customizing of the connector housing to provide a system of keying particular plug housings with particular receptacle housings. Although this type of keying arrangement does not require additional pieces to be used, the operator must program the deflectable keying members prior to mating the plug with the receptacle. The programming of the members is time consuming, and can be particularly difficult if the connector halves are positioned in an environment in which space is at a premium.

It would therefore be advantageous to provide a programmable keying system in which the programming of the keying occurred automatically as the connector halves were mated together. This would eliminate the input from the operator, and insure for the reliability of the keying system.

SUMMARY OF THE INVENTION

The invention is directed to a programmable keying system in which the programming of the keying occurs as the connectors are mated together. A connector housing with mating surface provided thereon, is provided with a keying means receiving recess proximate an end thereof. A keying means is provided in the recess.

The keying means has a first keying member and a second keying member. The first keying member is secured to the connector housing by first securing means, and the second keying member is frictionally maintained in cooperation with the first keying member. This insures that the second keying member is retained in position relative to the connector housing.

The second keying member has second securing means which extend therefrom, and are provided to cooperate with a mating connector housing.

The invention is also directed to a keying device for use with an electrical connector. The electrical connector has a first mating portion and a second mating portion, the second mating portion being movable relative to the first mating portion.

The keying device has a first keying means which is provided to cooperate with the first mating portion of the connector. The first keying means has first securing means which engage the first mating portion to retain the first keying means in the first mating portion. A second keying means is provided to cooperate with the first keying means and the second mating portion of the connector. The second keying means has a holding means which engage the first keying means to retain the second keying means in cooperation with the first keying means as required, and a second securing means which engages the second mating portion to retain the second keying means in the second mating portion.

DETAILED DESCRIPTION OF THE INVENTION

Figure 1:
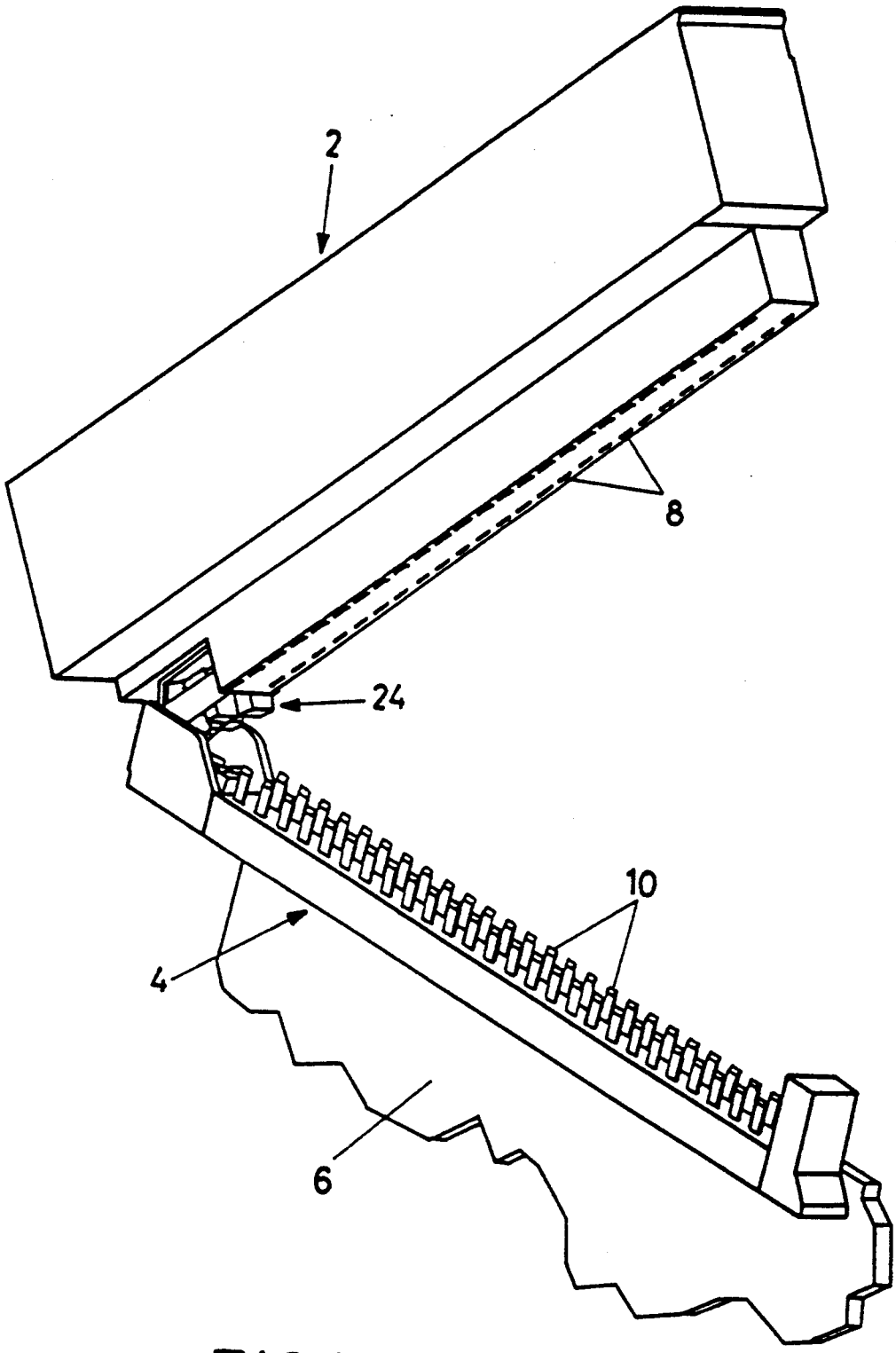
FIG. 1 is a perspective view a connector housing and a mating connector housing, each of the housings have a keying members provided therein.
Figure 2:
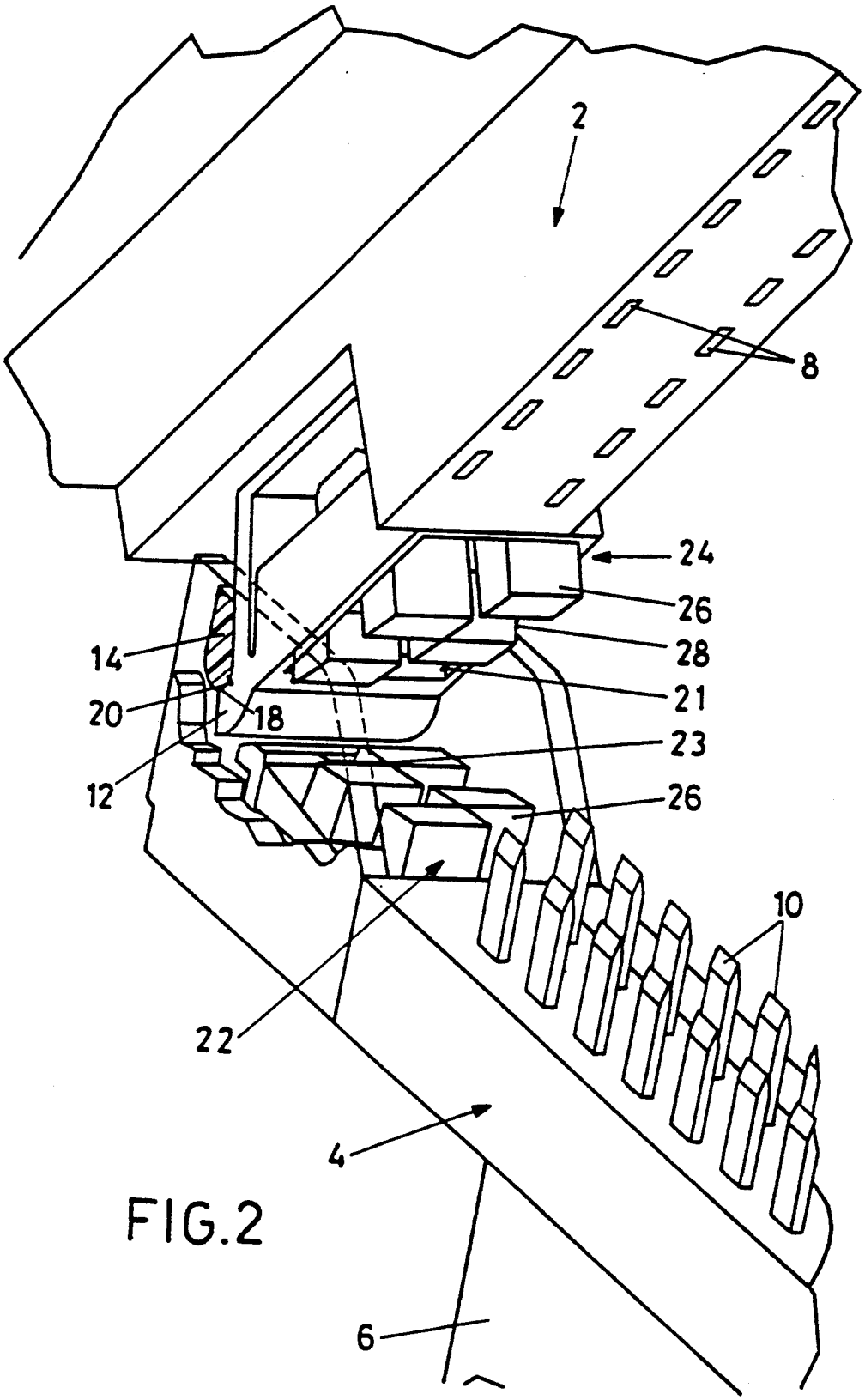
FIG. 2 is an enlarged perspective view of the keying members according to the teaching of the invention.

FIG. 1 illustrates a first connector housing 2 and a second connector housing 4 which are matable together. Such housings can be used for electrically connecting cable (not shown) with a printed circuit board 6. In the particular embodiment shown, first connector housing 2 has receptacle or female terminals provided in openings 8 which are in electrical engagement with the conductors of the cable, and second connector housing 4 has male terminals 10 which extend through the housing 4 to make electrical connection with conductors (not shown) provided on the printed circuit board 6.

Figure 4:
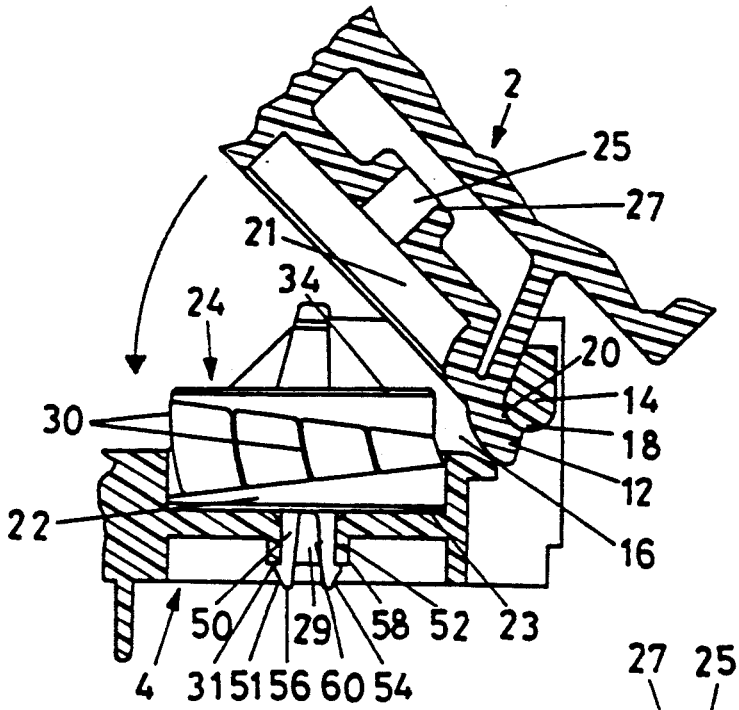
FIG. 4 is a fragmentary cross-sectional view, similar to that of FIG. 3, of the connector housings in the mated condition.
Figure 5:
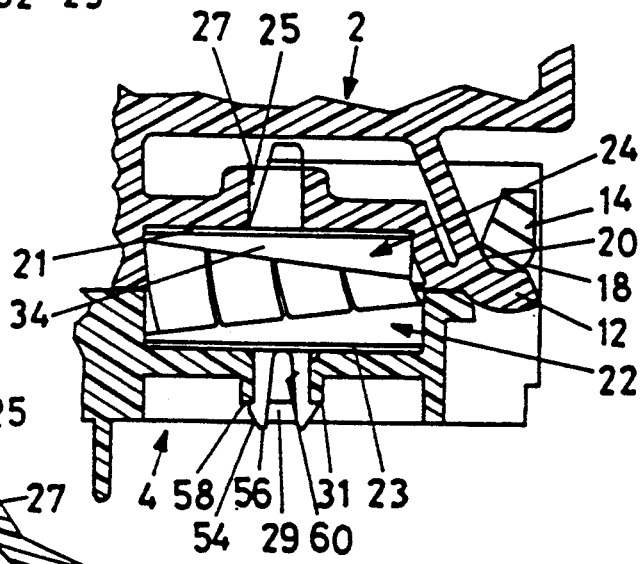
FIG. 5 is a fragmentary cross-sectional view, similar to that of FIG. 3, of the connector housings after the connector housings have been mated, the keying members being retained in the respective connector housings.
Figure 6:
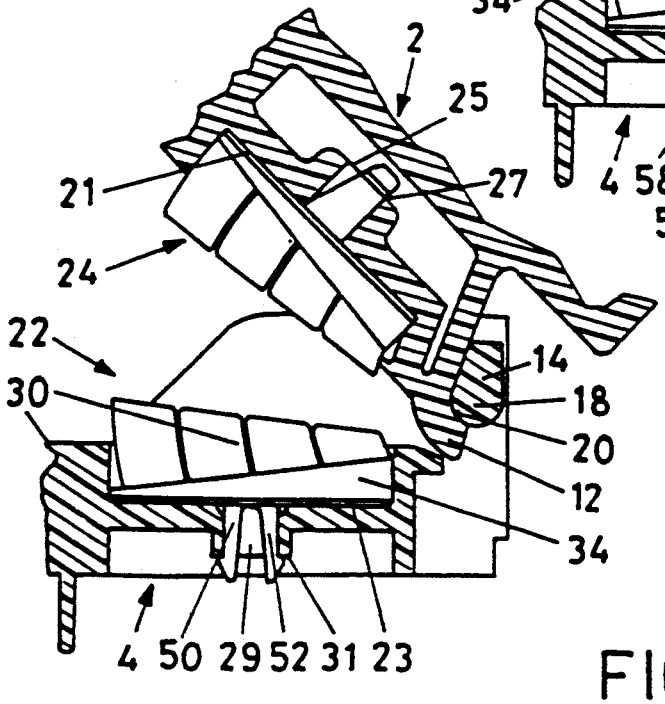
FIG. 6 is a fragmentary cross-sectional view, similar to that of FIG. 4, except that it shows the keying member of an upper one of the connector housings at a different position that in FIG. 4.

In order to mate the first connector housing 2 to the second connector housing 4, an arcuate mating arm 12 of the first connector housing 2 must cooperate with a pivot support 14 of the second connector housing 4, as best illustrated in FIGS. 4 through 6. In the initial or open position, in which the terminals are not mated together, the mating arm 12 of housing 2 is positioned in an opening 16 positioned adjacent to the pivot support 14 of housing 4. In this position a surface 18 of the mating arm 12 and a surface 20 of the pivot support 14 are placed in engagement with each other, thereby preventing a further opening of the connector housings.

In order to move the connector housings to a closed position, in which the terminals are placed in electrical engagement, a force is applied to housing 2, causing the housing to move in the direction indicated by the arrow of FIG. 4. The movement of housing 2 is controlled by the cooperation of the mating arm 12 and the pivot support 14. As the housing 2 is moved downward, a surface of the mating arm engages a surface of the pivot support, causing the mating arm to pivot about the pivot support to the position shown in FIG. 5. As pivoting connectors are known in the art, a further explanation of the operation of the connector housings 2, 4 will not be provided.

It is important to realize that, the housings 2, 4 are integrated as a male-female connection in a device having numerous different male-female connections which can be provided on the printed circuit board 6, and are essentially identical in appearance. However, although the appearances of these connectors may be essentially identical, the operation of each connector housing is distinct and separate. Consequently, it is important to provide the connector housings with a means to insure that only the proper connectors can be mated together, thereby eliminating the possibility of improper mating.

Therefore, each connector housing must be provided with a coding or keying system. In order to facilitate the placement of a keying system in the connector housings, each of the connector housings 2, 4 has a respective recess 21, 23. Recess 21 is positioned proximate mating arm 12. An opening 25 extends from the recess 21 in a direction away from the mating face of the housing. A shoulder 27 is provided adjacent the back end of the opening 25. Recess 23 is positioned proximate the pivot support 14. An opening 29 extends from the recess 23 in a direction away from the mating face of the housing. A shoulder 31 is provided adjacent the back end of the opening 29.

Figure 3:
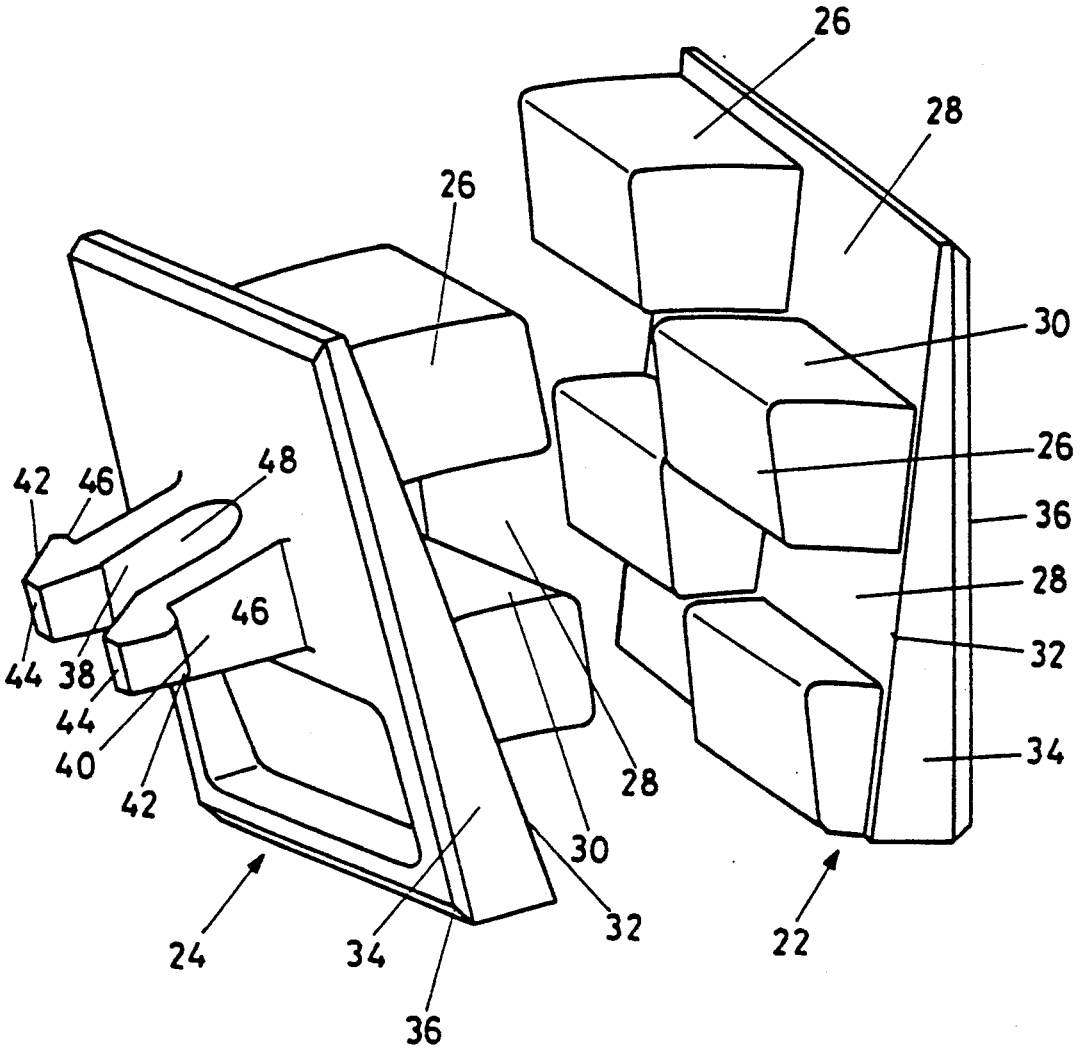
FIG. 3 is a fragmentary cross-sectional view of the connector housings prior to mating, both of the keying members are positioned in the connector housing.

Referring to FIG. 3, a coding or keying system is shown. The system has first keying means which comprise a first keying member 22 and second keying means which comprise a corresponding second keying member 24. Each keying member has a plurality of aggregated but spaced projections 26 and recesses 28, which can be referred to, for ease of reference, as a honeycomb of projections/recesses. The particular configuration of the projections and recesses are varied, so that the keying system for a particular connector provided on a printed circuit board will not be identical to any other keying system present on that circuit board. Thus, the projections 26 and recesses 28 act as a holding means to retain keying members 22, 25 in cooperation.

In order to allow the keying members 22, 24 to be mated together, the keying members must be configured such that each projection 26 provided on member 22 must have a corresponding recess 28 provided on member 24, and each projection 26 provided on member 24 must have a corresponding recess 28 provided on member 22. In other words, the honeycomb of projections/recesses of the keying member 22 is configured to mate with the honeycomb of projections/recesses of the keying member 24. It is worth noting that in the embodiment shown, the projections have arcuate side surfaces 30. This allows the keying members 22, 24 to be mated together as the housings 2, 4 are pivotally moved from the open position to the closed position. If the keying system is to be used in a connector in which the housings 2, 4 to be mated do not pivot relative to each other, the projections would have straight side surfaces, rather than arcuate.

Projections 26 extend from a first major surface 32 of a base plate 34. The base plate 34 has a second major surface 36 which extends as an angle relative to the first major surface 32. However, if the keying members are to be provided on a connector with a linear action, the first and second major surfaces would extend essentially parallel to each other.

Referring to key member 24, as shown in FIG. 3, key member 24 has a second securing means which includes a pair of mounting projections 38, 40 extend from the second major surface 36 of the base plate 34 in a direction which is essentially perpendicular to the surface 36. Each mounting projection has a lead-in surface 42 provided proximate a free end 44 thereof. A shoulder 46 is positioned proximate an end of the lead-in surface 42 which is provided nearer the base plate. The mounting projections 38, 40 have a recess 48 provided therebetween, such that the mounting projections are able to resiliently deflect into the recess 48, as will be more fully described.

Keying member 22, as shown in FIGS. 4 through 6, also has a first securing means which comprises a pair of mounting projections 50, 52 which extend from the second major surface 36 of the base plate 34 is a direction which is essentially perpendicular to the surface 36. Each mounting projection has a lead-in surface 54 provided proximate a free end 56 thereof. A shoulder 58 is positioned proximate an end of the lead-in surface 54 which is provided nearer the base plate. The mounting projections 50, 52 have a recess 60 provided therebetween, such that the mounting projections are able to resiliently deflect into, i.e. snap into and become locked in, the recess 60, as will be more fully described.

It is worth noting that mounting projections 38, 40 and mounting projections 50, 52 are provided at right angles to each other. This insures that each keying member can be mated with only one connector housing.

In use, keying member 22 and keying member 24 are provided in engagement with each other. The keying members are provided in engagement prior to the keying members being inserted into either connector housing. The keying members are maintained in engagement due to the frictional forces provided between the side surfaces 30 of the projections 26. Thus, side surfaces 30 and the projections 26 act as the holding means.

With the keying members 22, 24 mated together, the keying members are positioned in connector housing 4. The mounting projections 50, 52 of keying member 22 are inserted through recess 23 into opening 29. Insertion continues until shoulders 58 of the mounting projections cooperate with the shoulders 31 of the connector housing. This cooperation of the shoulders automatically locks keying member 22 in the housing 4, as shown in FIG. 4. In this inserted position, base plate 34 is positioned in recess 23. Projections 26 extend from recess 23 beyond the mating surface of housing 4. It is worth noting, that as previously described, keying member 24 is frictionally retained in cooperation with keying member 22 when the keying member 22 is positioned in recess 23.

With keying member 22 retained in recess 23 and keying member 24 frictionally engaged with member 22, the connector housing 2 is pivoted about housing 4 to the position shown in FIG. 5. As the housing 2 is pivoted, recess 21 is moved into cooperation with keying member 24. As this occurs, mounting projections 38, 40 of member 24 are inserted through recess 21 into opening 25. The insertion of mounting projections 38, 40 continues until connector housing 2 is fully inserted onto housing 4. In this fully inserted position, shoulders 46 of the projections 38, 40 engage shoulders 27 of housing 4. This engagement locks member 24 into housing 4.

As the connector housings are unmated, keying member 22 is retained in housing 4, and keying member 24 is retained in housing 2, as shown in FIG. 6. Consequently, as the connector housings are separated, each half has the appropriate keying arrangement, thereby preventing inappropriate connectors from being mated with either half.

Several advantages are provided by this type of keying system. As each connector housing 2, 4 does not have a keying member integrally molded therein, only one mold is required for the manufacture of each of connector housings 2, 4. This greatly reduces the cost of production.

Also, as the keying members 22, 24 can be provided in connector housings 2, 4 before shipment of the connector housing to the field, the programmability of the keying is automatically done when the connector housings are mated together. Therefore, upon mating of the connectors, the installer is not required to perform any special programming. Consequently, the reliability of the system is enhanced.

It is also important to note, that identical keying members can be used in a great variety of connectors. This allows the keying members to be mass produced, which reduces the cost associated therewith.

The use of this keying system also reduces the parts which must be retained in inventory. With each connector assembly which utilizes this type of keying, only two connector housings must be stored, one for each half of the connector. As the keying members can be universally applied to any of these connectors, only a limited number of keying members are required to be kept in stock. As the inventory is reduced, another cost savings is realized by this keying system.

Changes in construction will occur to those skilled in the art and various apparently different modifications and embodiments may be made without departing from the scope of the invention. The matter set forth in the foregoing description and accompanying drawings is offered by way of illustration only.

We claim:

1. A keying device for use with an electrical connector, the electrical connector having a first mating portion and a second mating portion, the second mating portion being movable relative to the first mating portion, the keying device comprising:

a first keying means cooperating with the first mating portion of the connector, the first keying means having a first securing means which engages the first mating portion to retain the first keying means in the first mating portion, the first securing means having a pair of resilient arms which extend from a second surface of the first keying means, and retaining surfaces are provided proximate free ends of the resilient arms, the retaining surfaces cooperating with shoulders of the first mating portion to maintain the first keying means in cooperation with the first mating portion;

a second keying means cooperating with the first keying means and the second mating portion of the connector, the second keying means having a holding means which cooperates with the first keying means to retain the second keying means in cooperation with the first keying means as required, and a second securing means which engages the second mating portion to retain the second keying means in the second mating portion; and the second securing means including at least one mounting projection configured to automatically lock with the second mating portion when the mounting projection is brought into engagement with the second mating portion.

2. A keying device as set forth in claim 1, wherein the first keying means has first keying projections and first keying recesses which are provided proximate a first surface thereof, the first keying projections extending from the first surface in essentially an opposed direction to the first securing means.

3. A keying device as set forth in claim 2, wherein the first keying projections have respective opposed side walls which have an arcuate configuration, thereby allowing the second mating portion to be pivotally mated to the first mating portion.

4. A keying device as set forth in claim 2, wherein the first keying projections have side walls which are essentially perpendicular to the first surface of the first keying means, thereby allowing the second mating portion to be linearly mated to the first mating portion.

5. A keying device as set forth in claim 1, wherein the second keying means has second keying projections and second keying recesses which are provided proximate a first surface thereof, the second keying projections extending from the first surface in essentially an opposed direction to the second securing means.

6. A keying device as set forth in claim 5, wherein the first keying projections are provided in alignment with the second keying recesses and the first keying recesses are provided in alignment with the second keying projections, such that as the first and second mating portions of the connector are mated, the respective projections will be provided in the respective recesses of the keying means.

7. A keying device as set forth in claim 1, wherein the at least one mounting projection of the second securing means comprises a pair of resilient arms which extend from a second surface of the second keying means, retaining surfaces are provided proximate free ends of the resilient arms, the retaining surfaces cooperate with shoulders of the second mating portion to secure the second keying means to the second mating portion.

8. A keying device as set forth in claim 1, wherein the first securing means and the second securing means are essentially perpendicular to each other.

9. A method of keying first and second mating connectors, the method comprising the steps of:

positioning a first keying means and a second keying means removably engaged with each other;

securing the first keying means in the first mating connector, such that the second keying means is maintained engaged with the first keying means;

mating the second mating connector to the first mating connector such that the second keying means becomes automatically secured to the second mating connector as the second mating connector is being mated to the first mating connector.

10. A method of keying mating connectors as recited in claim 9 wherein the first keying means and the second keying means fictionally engage each other.

11. A method of keying mating connectors as recited in claim 10 wherein the first keying means has first securing means provided thereon, the first securing means has a pair of resilient arms which extend from a second surface of the first keying means, retaining surfaces are provided proximate free ends of the resilient arms, the retaining surfaces cooperate with shoulders of the first mating connector to maintain the first keying means in cooperation with the first mating connector.

12. A method of keying mating connectors as recited in claim 11 wherein the second keying means has second securing means provided thereon, the second securing means has a pair of resilient arms which extend from a second surface of the second keying means, retaining surfaces are provided proximate free ends of the resilient arms, the retaining surfaces cooperate with shoulders of the second mating connector to maintain the second keying means in cooperation with the second mating connector.

13. A method of keying mating connectors as recited in claim 12 wherein the first and the second securing means of the first and second keying means cooperate with the respective first and second connectors such that as the connectors are pulled apart, the respective keying means are maintained in the connectors.

14. An electrical connector housing assembly having first and second mating surfaces provided thereon, the connector housing assembly comprising:

a receiving recess provided on each of the first and second mating surfaces proximate an end thereof;

a keying means provided in the recess, the keying means having a first keying member and a second keying member, the first keying member being secured to the first mating surface by first securing means, the first securing means having a pair of resilient arms which extend from the first keying member, and retaining surfaces are provided proximate free ends of the resilient arms, the retaining surfaces cooperating with shoulders of the first mating surface of the connector housing assembly to maintain the first keying member in cooperation with the connector housing; and the second keying member being frictionally maintained in cooperation with the first keying member, thereby insuring that the second keying member is retained in position relative to the connector housing, the second keying member having second securing means which extend therefrom, the second securing means including at least one mounting projection configured to automatically lock with the second mating surface when the mounting projection is brought into engagement with the second mating surface.

15. An electrical connector housing assembly as set forth in 14, wherein the first keying member has first keying projections and first keying recesses which are provided proximate a first surface thereof, the first keying projections extend from the first surface in essentially an opposed direction to the first securing means.

16. An electrical connector housing assembly as set forth in claim 15, wherein the second keying member has second keying projections and second keying recesses which are provided proximate a first surface thereof, the second keying projections extending from the first surface in essentially an opposed direction to the second securing means.

17. An electrical housing assembly as set forth in claim 16, wherein the first keying projections are provided in alignment with the second keying recesses and the first keying recesses are provided in alignment with the second keying projections.

18. An electrical connector housing assembly as set forth in claim 14, wherein the at least one mounting projection comprises a pair of resilient arms which extend from the second keying member, retaining surfaces are provided proximate free ends of the resilient arms, the retaining surfaces cooperating with shoulders of the second mating surface to maintain the second keying member in cooperation with the second mating surface.

* * * * *